US010124382B2

(12) United States Patent
Yamamoto et al.

(10) Patent No.: US 10,124,382 B2
(45) Date of Patent: Nov. 13, 2018

(54) BILLET TRANSPORT DEVICE FOR EXTRUSION PRESS

(71) Applicant: Ube Machinery Corporation, Ltd., Ube-shi (JP)

(72) Inventors: Takeharu Yamamoto, Ube (JP); Norihiro Nishioka, Ube (JP)

(73) Assignee: Ube Machinery Corporation, Ltd. (JP)

( * ) Notice: Subject to any disclaimer, the term of this patent is extended or adjusted under 35 U.S.C. 154(b) by 0 days.

(21) Appl. No.: 15/509,560

(22) PCT Filed: Jul. 1, 2015

(86) PCT No.: PCT/JP2015/069004
§ 371 (c)(1),
(2) Date: Mar. 8, 2017

(87) PCT Pub. No.: WO2016/080012
PCT Pub. Date: May 26, 2016

(65) Prior Publication Data

US 2017/0291205 A1 Oct. 12, 2017

(30) Foreign Application Priority Data

Nov. 19, 2014 (JP) ..... 2014-234257

(51) Int. Cl.

| | |
|---|---|
| ***B21C 33/00*** | (2006.01) |
| ***B21C 23/21*** | (2006.01) |
| ***B21C 23/00*** | (2006.01) |
| ***B21C 29/02*** | (2006.01) |

(52) U.S. Cl.
CPC ..... *B21C 33/00* (2013.01); *B21C 23/001* (2013.01); *B21C 23/21* (2013.01); *B21C 23/214* (2013.01); *B21C 29/02* (2013.01); *B21C 33/006* (2013.01)

(58) Field of Classification Search
CPC ..... B21C 33/00; B21C 23/001; B21C 29/02; B21C 33/006; B21C 23/21; B21C 23/214
USPC ..... 72/270
See application file for complete search history.

(56) References Cited

U.S. PATENT DOCUMENTS 3,581,545 A * 6/1971 Asari ..... B21C 23/21 72/263
4,781,053 A * 11/1988 Stewart ..... B21C 23/214 72/255

FOREIGN PATENT DOCUMENTS

| | | |
|---|---|---|
| JP | 51-096029 | 8/1976 |
| JP | 60-020818 A | 2/1985 |
| JP | 07-032032 A | 2/1995 |
| JP | 07-195117 A | 8/1995 |
| JP | 2001-129610 A | 5/2001 |
| JP | 2001-335839 A | 12/2001 |
| JP | 2007-160335 A | 6/2007 |

* cited by examiner

*Primary Examiner* — David B Jones
(74) *Attorney, Agent, or Firm* — DLA Piper LLP (US)

(57) ABSTRACT

A billet transport device inserts a billet emerging from a billet heater into a container of an extrusion press device, and includes a conveyor transporting a billet from a billet heater, an overhead type billet carrier directly transporting a billet from the conveyor to a billet loader, and a billet loader transporting a billet from the outside to inside of the extrusion press device. Further, the billet loader is comprised of an insertion roller device inserting a billet into a container and a billet insertion device placed at the front end of the billet loader.

3 Claims, 5 Drawing Sheets

PRIOR ART

PRIOR ART

BILLET TRANSPORT DEVICE FOR EXTRUSION PRESS

TECHNICAL FIELD

The present invention relates to a billet transport device for supplying a billet to an extrusion press device.

BACKGROUND ART

In general, when extruding a billet made of a metal material, for example, aluminum or its alloy, from an extrusion press device, a hydraulic cylinder is used to drive a main ram. At the front end of the ram, an extrusion stem is attached. A billet is inserted by a billet inserter into a container in the state where the container is pushed against a die. The main ram is made to advance driven by the hydraulic cylinder whereby the billet is pushed by the extrusion stem. Therefore, a shaped product is extruded from the opening part of the die. After extruding the billet, the container is made to retract somewhat by the container cylinder and the discard (remaining part of the billet) is pulled out from the container. The work is called "container stripping". After the discard is removed from the container, the main ram and container start to retract. Next, the blade of a shear device is inserted between the container and die to cut off the billet remaining at the die surface (that is, the discard). After that, the main ram is made to further retract to completely pull out the extrusion stem from the container and return the extrusion stem to its initial position. The next billet is inserted into the container and the extrusion operation of the next extrusion cycle is proceeded to.

An extrusion press device is provided with a billet transport device. As a specific example of such a billet transport device, the prior art shown in FIGS. 4 and 5, PLT 1, etc. may be mentioned. The billet transport device 124 of the prior art of FIGS. 4 and 5 is comprised of a billet heater 121, free rollers 122, a billet loading device tray 123, rails 125, a billet pusher 126, a billet loader 127, etc. The extrusion press device is comprised of an end platen 101, container 103, extrusion stem 105, main crosshead 106, main cylinder 107, main ram 108, side cylinder 109, container cylinder 111, etc. As seen in the prior art of FIG. 4, when using the extrusion press device to perform an extrusion operation, the starting material, that is, the billet, is extruded to obtain a product. First, the billet 110 is preheated inside the billet heater 121. Using a start command of the extrusion cycle, that is, a "billet call" (instruction from extrusion press demanding billet from billet heater), a billet 110 leaves the billet heater 121, passes over the free rollers 122, then is placed on the billet loading device tray 123. The billet loading device tray 123 carrying the preheated billet 110 moves over the rails 125 and moves close to the extrusion press device. The billet is pushed by the billet pusher 126 and moves to the roller part of the billet loader 127 (insertion rollers 133, see FIG. 5). After that, the billet loader 127 is used to move the billet to the center of the extrusion press device and insert it into the container 103.

Referring to FIG. 4, the flow of operation of billet transport of the prior art will be explained. The following (1) to (8) are shown in FIG. 4 as a reference display of the corresponding flow of operation.

(1) A billet 110 is preheated by the billet heater 121, then moves over the free rollers 122 and is placed on the billet loading device tray 123 at the position S.

(2) At the billet movement device 124, the billet loading device tray 123 carrying the billet 110 passes over the rails 125 and is moved to a position T near the extrusion press.

(3) The billet pusher 126 pushes the billet 110 on the billet movement device tray 123 to move it to the billet insertion device 134 of the billet loader 127.

(4) The billet pusher 126 is retracted.

(5) The billet loader 127 moves to the extrusion press center (see imaginary lines of 127 and 134).

(6) At the billet insertion device 134 of the billet loader 127, the billet insertion member 132 pushes against the billet 110 and moves it over the insertion rollers 133 (see FIG. 5) to insert the billet 110 to the inside of the container 103.

(7) The billet loader 127 is retracted to the initial position.

(8) The billet insertion member 132 returns to its original position.

FIG. 5 shows details of the billet insertion device 134 of the billet loader 127. In the billet insertion device 134 of the billet loader 127, the insertion rollers 133 were single parts, that is, were not split but were integral rollers. Further, the insertion rollers 133 were not that large in diameter, so the arc-shaped grooves formed by the contact of the billet 110 and insertion rollers 133 were shallow, so the billet 110 could not be stably carried. To stably carry the billet 110, it was necessary to provide supports at the two sides of the billet 110 and clamp the billet 110 from the two sides. However, if trying to place the billet 110 on the insertion rollers 133 by an overhead type billet carrier 40, arms 41 of the overhead type billet carrier 40 (see FIG. 2) would interfere with the supports 131 preventing the billet 110 from being placed on the insertion rollers 133. Therefore, in the prior art, it was not possible to use an overhead type billet carrier 40 to utilize the top space and place a billet 110 on the billet insertion device 134. It was necessary to use the billet pusher 126. Further, there was chains (not shown in FIG. 5) for driving the billet insertion member 132 of the billet insertion device 134, rails 135, and wheel rollers 136 guided by the top and bottom rails 135 at the two sides of the insertion rollers 133, so the billet insertion device 134 became greater in width as a whole. In the billet loader of PLT 1 as well, the arms of the overhead type billet carrier interfered with the loader frames 22 and 23 of the billet insertion device, so the above problems arose.

CITATION LIST

Patent Literature

PLT 1: Japanese Unexamined Patent Publication No. 2007-160335A

SUMMARY OF INVENTION

Technical Problem

In the above way, in extrusion presses of the prior art, there were the following problems. In the prior art, when loading a billet in the billet supply device, the billet emerging from the billet heater could not be directly moved to the billet loader, so a long time was required for billet transport and the billet dropped in temperature. Around the billet transport device, there were the usual billet carrier and billet pusher, so while it was possible to access the inside of the extrusion press device, maintenance was not easy. Further, in the billet insertion device of the prior art, the width was large and the number of parts great. Furthermore, the billet was not stably carried on the rollers, so supports (131 in FIG.

5 etc.) became necessary. At the same time as being large in number of parts, the handling of the billet at the overhead type billet carrier was obstructed. An "overhead type billet carrier" indicates a transport device with two arms or other parts for clamping objects which ascend or descend and transport objects through the air between two points.

Solution to Problem

A billet transport device for inserting a billet emerging from a billet heater to a container of an extrusion press device, includes of a conveyor transporting the billet from the billet heater, an overhead type billet carrier directly transporting the billet from the conveyor to the billet loader, and a billet loader transporting the billet from the outside of the extrusion press device to the inside.

The billet loader further includes an insertion roller device inserting a billet inside the container and a billet insertion device placed at a front end of the billet loader.

The insertion rollers were structured split into two and the contact surfaces of the centerlines of the insertion rollers and the billet were made about 30 to 45 degrees in angle.

The billet insertion member is arranged at the billet insertion device so that the billet insertion member passes between the split insertion rollers in the billet insertion direction, while inserting a billet to the inside of the container.

Advantageous Effects of Invention

By using an overhead type billet carrier to directly supply a billet, transport by the usual billet carrier (usual clamping mechanism not of the overhead type) and billet pusher, which were required in the prior art, becomes unnecessary, the transport time can be slashed, and the drop in temperature of the billet becomes minimal.

The usual billet carrier and billet pusher become unnecessary, so the inside of the extrusion press device becomes easier to access, space can be saved, and maintenance becomes easier.

In the billet loader, the rollers receiving the billet are split to the two sides from the center of the billet center to secure a path for the billet insertion member used as the pusher for inserting the billet into a container. Further, the supports for holding the billet at the center of the billet center become unnecessary. Since the supports supporting the billet at the two sides are eliminated and the overhead type billet carrier no longer interferes with the supports at the descent limit, handling of the billet by the overhead type billet carrier became possible. Further, the billet insertion member is structured coupled with the linear guides 63, so does not use the rails 135 and wheel rollers 136 which were required in the past. The number of parts are slashed and resources are conserved.

It is possible to employ linear guides 63 and make the guide positions closer to the extrusion press than in the prior art (see FIG. 3). Due to this, it is possible to place the pinion 53 directly under the billet insertion device near the extrusion press so that the size of the moving frame becomes smaller and space saving and resource saving can be realized.

DESCRIPTION OF EMBODIMENTS

Figure 1:
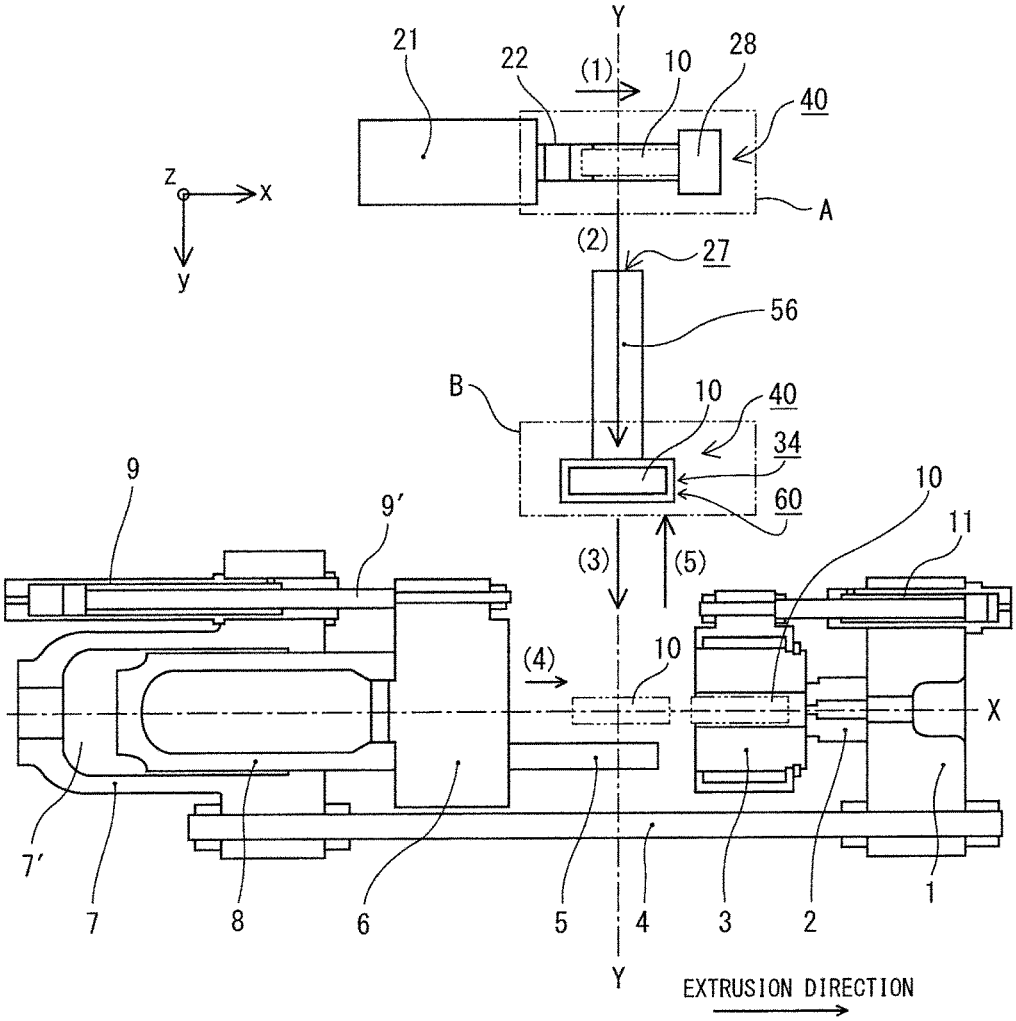
FIG. 1 is an overall schematic plan view of a billet transport device of the present invention. The overhead type billet carrier 40 is omitted. The extrusion direction is made the x-axis, the direction of reciprocating motion of the overhead type billet carrier 40 is made the y-axis, and the height direction is made the z-axis. The center axis of the extrusion press is the X-axis.

An embodiment of a billet transport device according to the present invention will be explained in detail below while referring to the drawings.

An extrusion press used in the present invention is shown in FIG. 1. An end platen 1 and a main cylinder 7 are arranged facing each other. The two are connected by a plurality of tie rods 4. At an inside surface of the end platen 1 (surface facing main cylinder 7), a die 2 in which an extrusion hole is formed is provided. Between a die 2 of the end platen 1 and the main cylinder 7, a container 3 is arranged. A billet 10 is loaded in the loading hole of the container 3 and is pushed so as to be pushed out toward the die 2 whereby a product of a cross-section corresponding to the die hole is extruded. The container 3 is sealed by a container cylinder 11 during the extrusion operation. Here, the end platen 1 side is defined as the "front" and the main cylinder 7 side is defined as the "rear".

The main cylinder 7 generating the extrusion action force houses a main ram 8 and can press against this to move it toward the container 3 by the hydraulic cylinder 7'. At the front end part of the main ram 8, a main crosshead 6 is set. The extrusion stem 5 is arranged coaxially with the billet loading hole of the container 3 and is attached to the main crosshead 6 in a state projecting out toward the container 3. At the front end of the extrusion stem 5, a not shown fix dummy block is attached in close contact. The center axis of the die 2, the center axis of the billet loading hole of the container 3, and the center axis of the extrusion stem 5 match. This will be referred to as the center axis X of the extrusion press. In FIG. 1, the extrusion stem 5 is not arranged on the center axis X. When the billet loader 27 places a billet 10 on the center axis X, in the present embodiment, the extrusion stem 5 is retracted to the side (y-direction). After the billet 10 is inserted by the billet loader 27 into the billet loading hole of the container 3, the extrusion stem 5 returns to the center axis X. Therefore, if driving the main cylinder 7 to make the main crosshead 6 advance, the extrusion stem 5 is inserted in the billet loading hole of the container 3, the rear surface of the loaded billet 10 is pushed against, and the billet 10 is extruded so that a product is formed.

At the main cylinder 7, a plurality of side cylinders 9 are attached in parallel with the center axis X. The cylinder rod 9' is connected with the main crosshead 6. As the preparatory step of the extrusion step by the side cylinder 9, the extrusion stem 5 is first made to move to a position close to the container 3. The extrusion and pressing operation is performed using both of the main cylinder 7 and the side cylinder 9.

In FIG. 1, the billet transport device of the extrusion press device includes free rollers 22, a billet loader 27, a billet insertion device 34, an insertion roller device 60, and an overhead type billet carrier 40 (shown by imaginary lines at position A and position B). Instead of the free rollers 22, drive rollers may be provided. Another conveyor may also be used. When a billet 10 emerges from the billet heater 21 and stands by on the free rollers 22, the overhead type billet carrier 40 descends and clamps the billet 10 by the arms 41. After that, the arms 41 clamping the billet 10 rise, move to directly above the insertion roller device 60 of the billet loader 27, then stop. After that, the arms 41 descend. When moving to the bottommost point, they stop there, then the arms 41 open and place the billet 10 on the insertion rollers 61 of the insertion roller device 60. This state is shown as the position B of FIG. 1 and in FIG. 2A. Note that, the overhead type billet carrier is not limited to the present embodiment. It is sufficient that is be a transport device where two arms or other parts for clamping objects ascend and descend and transport objects through the air between two points. After that, the billet loader 27 advances and stops when the billet 10 reaches the position of the center axis X of the extrusion press device. This state is shown at the position C of FIG. 2B. The line Y-Y is the centerline of movement of the billet up to here. The billet insertion member (pusher) 64 placed at the billet insertion device 34 advances while running between the insertion rollers 61 in the billet insertion direction and inserts the billet 10 inside of the container 3. While explained later, the insertion rollers 61, 61 are split to the left and right in the X-axis and are arranged symmetrically to the left and right. For this reason, the billet insertion member 64 can run on the X-axis.

Figure 2A:
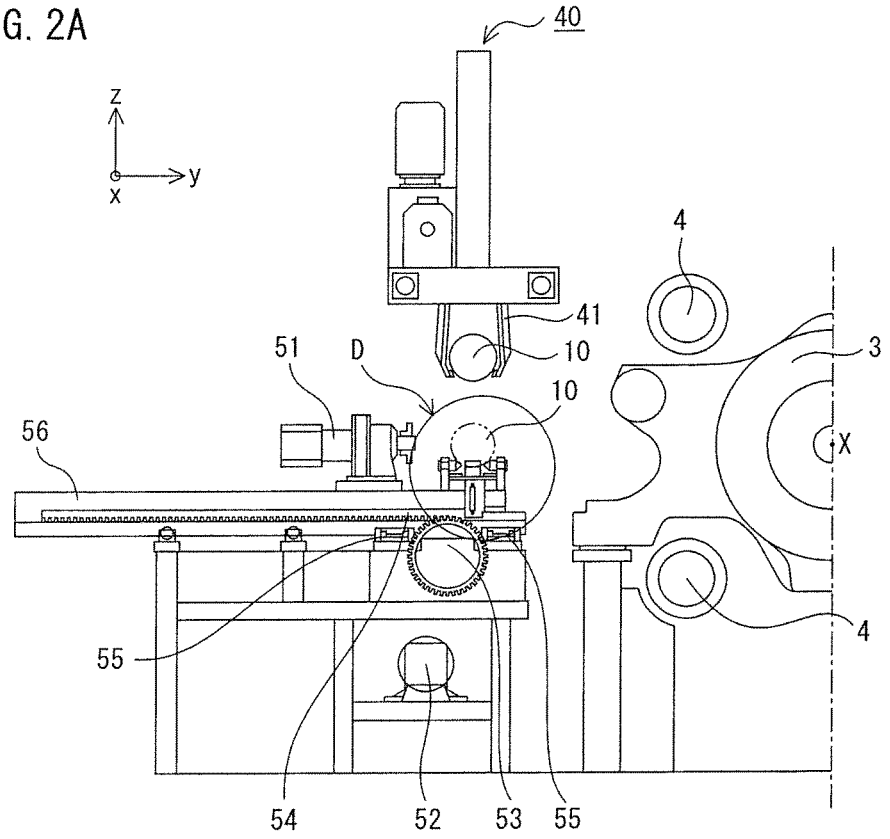
FIG. 2A is a schematic view of a billet loader of the present invention and a side view seen from the x-direction from the line Y-Y of FIG. 1 when the billet loader of the present invention is at the position B of FIG. 1.
Figure 3:
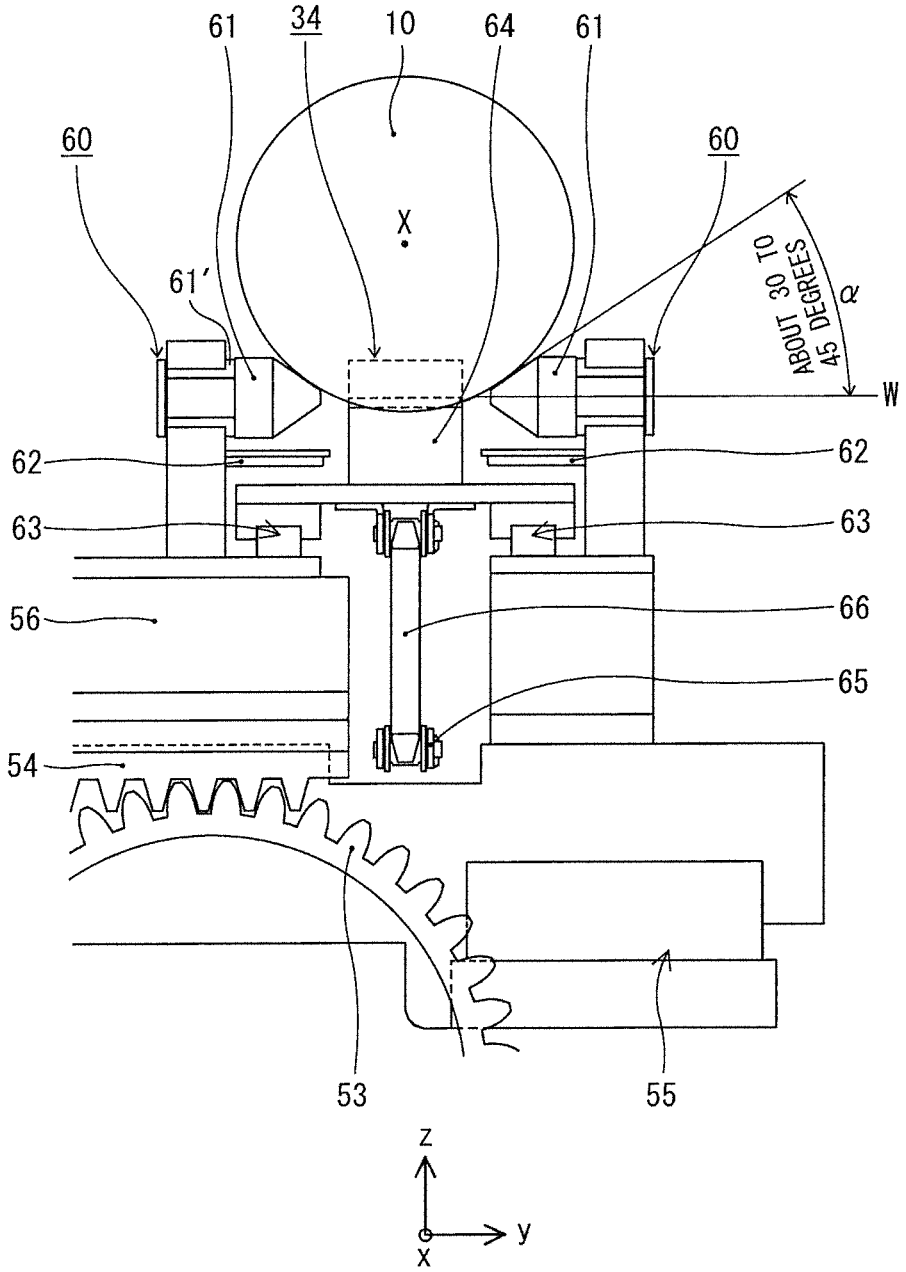
FIG. 3 is an enlarged view of part D of FIG. 2A and an explanatory view of a billet insertion device and insertion roller of the billet loader of the present invention.
Figure 4:
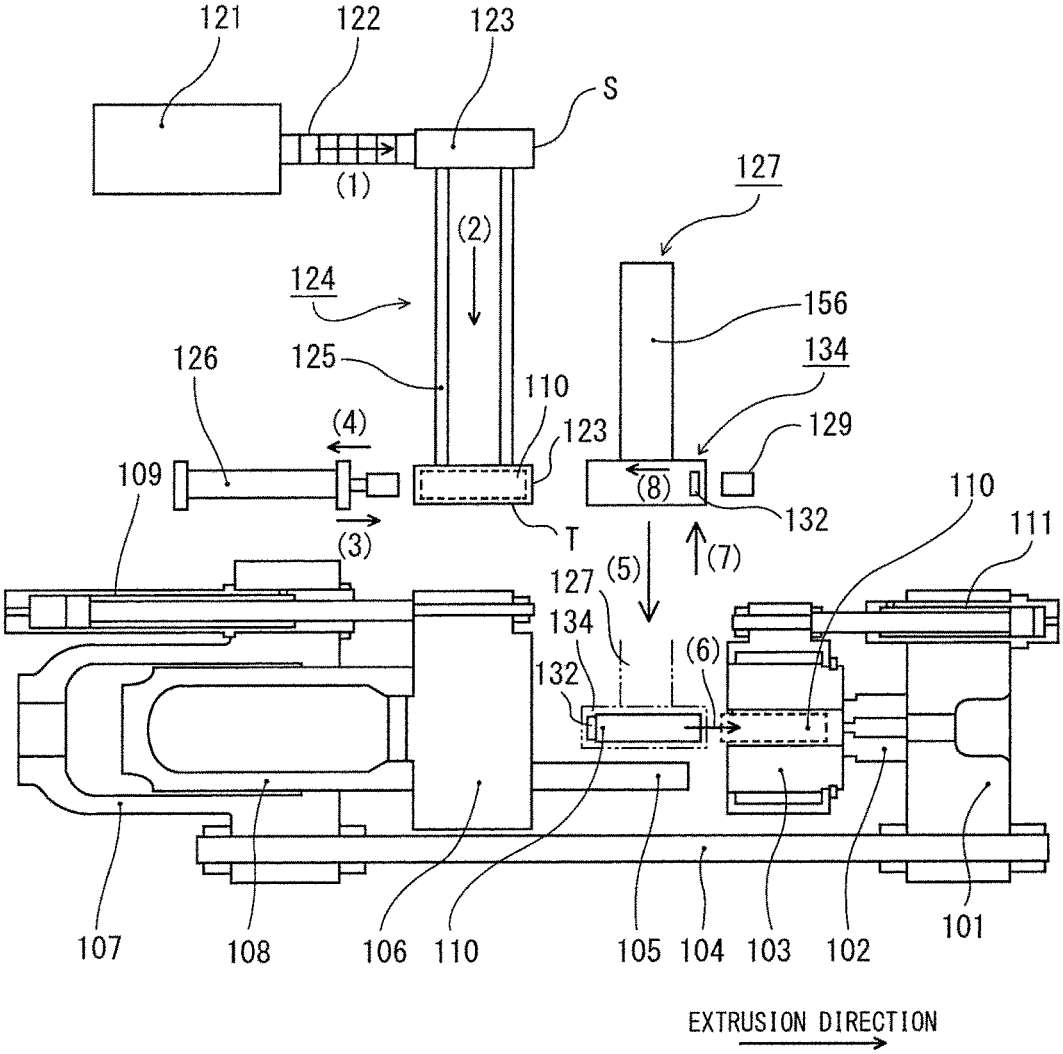
FIG. 4 is an explanatory view of billet transport of a billet loader 127 of the prior art.
Figure 5:
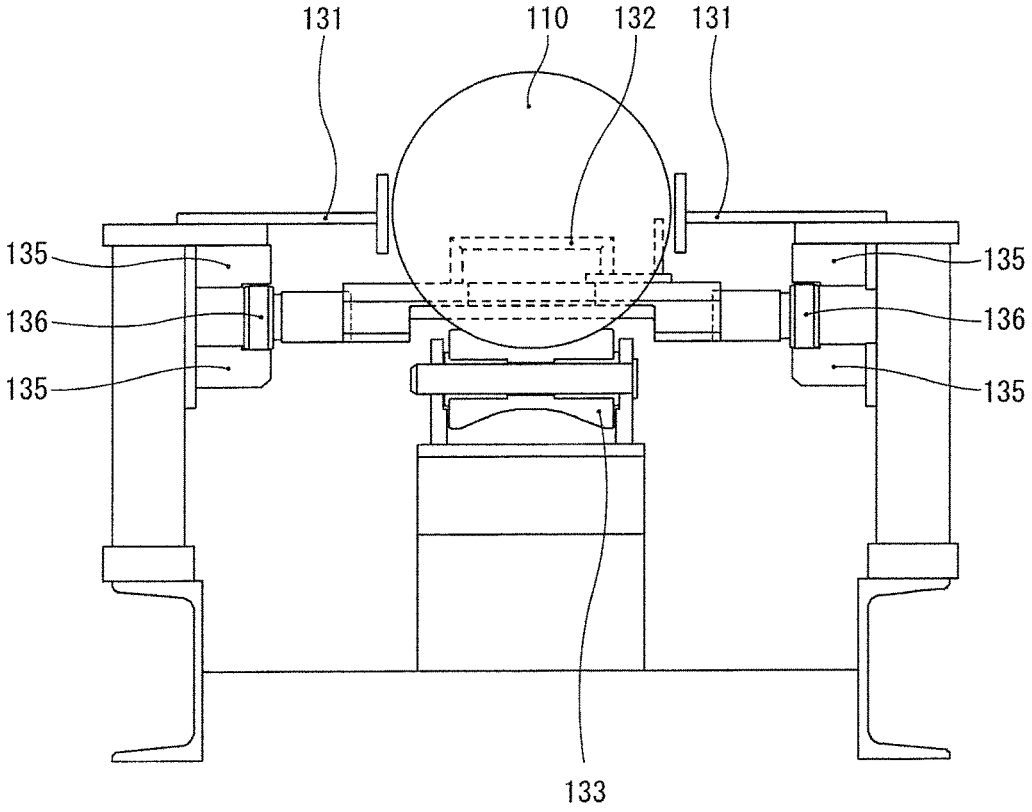
FIG. 5 is a schematic cross-sectional view of a billet insertion device 134 of the prior art.

FIG. 2A is a view seen in the x-direction from the line Y-Y of FIG. 1. The moving frame 56 is driven through not shown guides by the motor 52 and the pinion 53 and rack 54 to be able to move in the y-direction of FIG. 2A. In the prior art, the pinion 53 was positioned at a far position from the extrusion press, but this is moved to a position such as shown, that is, to directly below the billet insertion device 34 close to the center axis X of the extrusion press. The reason why this is possible is that in the prior art of FIG. 5, the billet insertion member 132 of the billet loader 127 pushed against the billet 110 to insert it inside the container 103. This movement of the billet insertion member 132 was driven by chains (not shown) provided at the left and right of FIG. 5. At this time, the two chains occupied space and interfered with operation, but in the present embodiment, as shown in FIG. 3, the chain 65 is made singular. Due to this, the pinion gear 53 and the linear guide 55 of the moving frame 56 can be positioned close to directly below the billet insertion device 34. Further, the linear guide 55 is made to be set at the center axis X side, so the distance between the billet 10 and the center axis X is shortened. For this reason, even if the billet loader 27 moves to the center axis X of the extrusion press, it will no longer tilt to the front. Furthermore, the length of the moving frame 56 of the billet loader 27 can be shortened by about 500 mm and the billet loader 27 can be made compact. The reason why the billet loader 27 becomes compact is the linear guide 55 is employed and the guide position is offset to the center axis X side of the extrusion press device. Further, this is because the moving frame 56 can be offset to the center axis X side of the extrusion press by that amount. In FIG. 2A and FIG. 3, reference numeral 55 is a linear guide. The moving frame 56 can move back and forth in the x-direction on the linear guide 55. The linear guide 55 guides the movement in the x-direction of the moving frame 56. The linear guide 55 and the later explained linear guides 63 differ in application. The linear guide 55 is an x-direction guide of the moving frame 56, while the linear guides 63 are x-direction guides of the billet insertion member 64. Further, FIG. 2A is a side view wherein reference numeral 40 shows the overhead type billet carrier. The overhead type billet carrier is guided in the y-axial direction by a not shown slide guide. The overhead type billet carrier clamps a billet 10 emerging from the billet heater 21 (position A of FIG. 1) and placed on the free rollers 22 by the arms 41 and moves it to a position for placement on the insertion rollers 61 (position B of FIG. 1). After that, the overhead type billet carrier 40 descends and places the billet 10 on the insertion roller 61.

FIG. 3 shows an insertion roller device 60 and billet insertion device 34 of the present embodiment. The insertion roller device 60 is comprised of insertion rollers 61 etc. The billet insertion device 34 is comprised of a billet insertion member 64 and a drive unit including motor 51, chain 65, etc. FIG. 3 enlarges the part D of FIG. 2. The insertion roller device 60 of the billet loader 27 of the present embodiment has a plurality of insertion rollers 61 arranged in the x-axial direction. The insertion rollers 61 are structured split into two to the left and right in FIG. 3 in the X-axial direction. The split insertion rollers 61 are conical shaped or frusto-conical shaped and have angles of contact with the billet 10 of angles of about 30 to 45 degrees from the centerline W of the insertion rollers 61. In this case, the rollers need not be strictly conical shaped. The individual insertion rollers 61 are held by bushes 61' and are designed to be able to freely rotate. The angles $\alpha$ by which they contact the billet 10 are angles of about 30 to 45 degrees from the centerlines W of the insertion rollers 61, so a billet 10 can be stably carried without lateral shifting when placed. With the insertion rollers 133 of FIG. 5, it was not possible to deeply support a billet 10, but if supporting a billet 10 from the left and right by the split insertion rollers 61 of the present embodiment, stable support is possible. The insertion rollers 61 receiving the billet 10 are split at the center of the billet center (same as X-axis) to thereby secure a path for the billet insertion member 64 at the center. For this reason, when inserting the billet 10 in the container 3, the billet 10 is inserted through this path. Further, the billet insertion member 64 has the linear guides 63 for the billet insertion member 64. The rails 135 and the wheel rollers 136 required in the prior art of FIG. 5 need not be used. Furthermore, the drive part of the billet insertion member 64 is made a single chain 65, so the sprocket 66 and chain 65 can be placed below the billet insertion member 64, so the width in the lateral direction becomes smaller and the size becomes compact.

A billet 10 is placed on the free rollers 61 of the insertion roller device 60, then the billet loader 27 is made to advance. After the billet insertion device 34 and insertion roller device 60 reach the center axis X of the extrusion press, the billet insertion device 34 inserts the billet 10 into the container 3. The billet insertion device 34 drives the chain 65 by the motor 51 to thereby make the billet insertion member 64 advance. Reference numeral 66 is a sprocket. The billet insertion member 64 is placed on two linear guides 63. Further, reference numeral 62 is a cover. This is a covering member for protecting against dust. The debris deposited on a billet 10 is kept from falling onto the linear guides 63.

FIG. 1 shows the flow of operation of billet transport of the present invention. The following (1) to (5) are shown as a reference display of the corresponding flow of operation in FIG. 1.

(1) A billet 10 is preheated by the billet heater 21 and moves over the free rollers 22 to the position of the stopper 28.

(2) The overhead type billet carrier 40 clamps the billet 10 at the position A. Further, the overhead type billet carrier 40 rises and transports the billet 10 to the center part (position B) of the insertion rollers 61 of the insertion roller device 60. Here, the overhead type billet carrier 40 releases the billet 10 and rises.

Figure 2B:
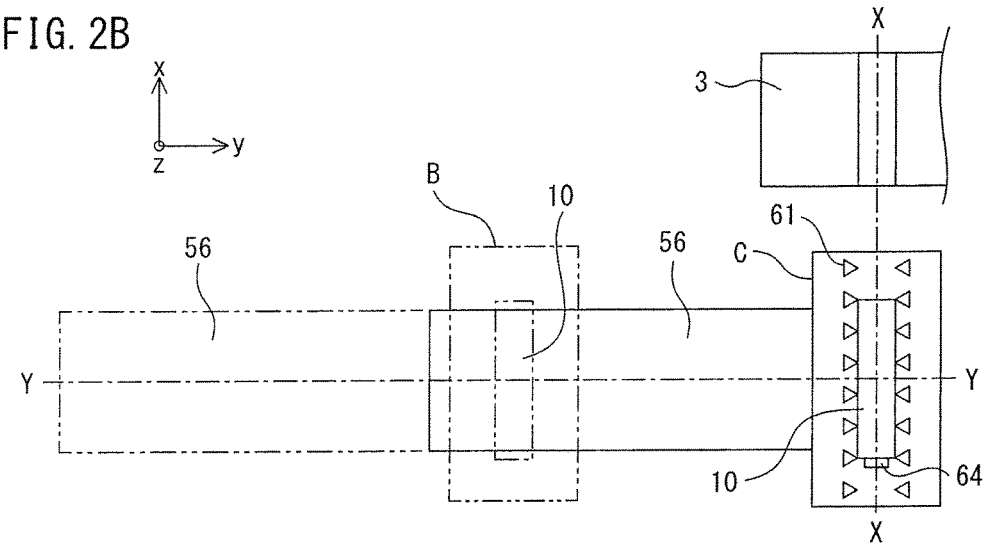
FIG. 2B is a schematic plan view when the billet loader of the present invention 27 advances from the retracted position B to an advanced position C.

(3) The billet loader 27 moves to the extrusion press center, that is, the X-axis (position C of FIG. 2B).

(4) The billet insertion member 64 of the billet loader 27 pushes against the billet 10. The billet 10 is moved so as to slide over the rotating insertion rollers 61 whereby the billet 10 is inserted inside the container 3.

(5) The billet loader 27 retracts to the position B.

The present invention has the following advantageous effects due to being configured as above.

By directly supplying a billet by the overhead type billet carrier, transport by the usual billet carrier and billet pusher, required in the prior art, becomes unnecessary, the transport time can be slashed, and the drop in temperature of the billet becomes minimal.

The usual billet carrier and billet pusher become unnecessary, so the inside of the extrusion press device becomes easier to access, space can be saved, and maintenance becomes easier.

In the billet loader, the rollers receiving a billet are split to the two sides of the center of the billet center (X-axis) to secure a path for the billet insertion member serving as the pusher for inserting the billet into a container. Further, the supports designed to be able to hold the billet at the center of the billet center became unnecessary. The supports supporting the billet at the two sides are eliminated and the overhead type billet carrier no longer interferes with the supports at the descent limit, so handling of the billet by the overhead type billet carrier became possible. Further, the billet insertion member is structured coupled with the linear guides 63, so does not use the rails 135 and wheel rollers 136 which were required in the past. The number of parts are slashed and resources are conserved.

It is possible to employ linear guides 63 and make the guide positions closer to the extrusion press than in the prior art (see FIG. 2). Due to this, it is possible to place the pinion 53 directly under the billet insertion device near the same so that the size of the moving frame becomes smaller and space saving and resource saving can be realized.

REFERENCE SIGNS LIST

1. end platen
2. die
3. container
4. tie rod
5. extrusion stem
6. main crosshead
7. main cylinder
8. main ram
9. side cylinder
10. billet
21. billet heater
22. free roller (conveyor)
27. billet loader
28. stopper
34. billet insertion device
40. overhead type billet carrier
41. arms
51. motor
52. motor
53. pinion gear
54. rack gear
55. linear guide
56. moving frame
60. insertion roller device
61. insertion roller
62. cover
63. linear guide
64. billet insertion member
65. chain
66. sprocket
123. billet loading device tray
124. billet movement device
125. rails
126. billet pusher
131. support
132. billet insertion member
133. insertion roller
134. billet insertion device
135. rails
136. wheel roller

The invention claimed is:

1. A billet transport device that inserts a billet ejected from a billet heater into a container of an extrusion press device, comprising:

a conveyor transporting the billet from a billet heater, a billet loader receiving the billet from said conveyor and inserting the billet into said container, and an overhead billet carrier directly transporting the billet from said conveyor to said billet loader, wherein said billet loader includes an insertion roller device and a billet insertion device inserting the billet inside said container, a plurality of pairs of insertion rollers are placed at said insertion roller device, and each of the pairs of the insertion rollers are aligned on a common rotational axis with a space therebetween, and wherein a billet insertion member placed at said billet insertion device passes through the space between each of the pairs of the insertion rollers in a billet insertion direction while inserting the billet inside the container.

2. The billet transport device according to claim 1, wherein each of said insertion rollers has a conical or frustoconical end.

3. The billet transport device according to claim 2, wherein a half apex angle of the conical or frustoconical end of each of said insertion rollers is 30 to 45 degrees.

* * * * *